United States Patent [19]

West

[11] Patent Number: 4,779,243

[45] Date of Patent: Oct. 18, 1988

[54] TRANSDUCER ARRAY VELOCITY SENSOR AND PROCESSOR SYSTEM

[75] Inventor: Gerald W. West, King County, Wash.

[73] Assignee: Honeywell, Inc., Minneapolis, Minn.

[21] Appl. No.: 26,814

[22] Filed: Mar. 17, 1987

[51] Int. Cl.[4] ..... H04R 00/00

[52] U.S. Cl. ..... 367/137; 367/87; 367/190

[58] Field of Search ..... 367/190, 55, 87, 137

[56] References Cited

U.S. PATENT DOCUMENTS 4,166,381 9/1979 Woo ..... 73/54

4,516,230 5/1985 Goodloe et al. ..... 367/190

*Primary Examiner*—Thomas H. Tarcza

*Assistant Examiner*—Daniel T. Pihulic

*Attorney, Agent, or Firm*—C. Lamont Whitham; Michael E. Whitham

[57] ABSTRACT

A differential transformer is used as a feedback sensor for generating an error signal sensed at the face of an element of a sonar transducing array. This error signal is used to correct the excitation signal to the transducer to correct both phase and amplitude errors in the vibration of the radiating surface of the transducer. In this way, the transmitting beam pattern for the sonar array is improved. The differential transformer is capable of sensing the mechanical motion of the transducer radiating surface without being affected by a strong electric or magnetic field. By using a separate differential transformer sensor and processing circuit for each transducer in the array, electrical cross-talk between the individual elements of the array is eliminated.

5 Claims, 4 Drawing Sheets

TRANSDUCER ARRAY VELOCITY SENSOR AND PROCESSOR SYSTEM

BACKGROUND OF THE INVENTION

1. Field of the Invention

The present invention generally relates to the improvement of sonar transmitting beam patterns and, more particularly, to the use of a differential transformer as a feedback sensor for generating an error signal sensed at the face of an element in an acoustical transducer array.

2. Description of the Prior Art

Each element in a sonar transmitting array is subjected to the energy of all other transmitting elements in the array. It is therefore possible that each element is vibrating at an amplitude and phase other than that which is intended. This leads to distorted transmit beam patterns. Thus, there is a need for a system which is capable of sensing and correcting the actual amplitudes and phases of the vibrations of the individual elements in the transmitting array.

In the prior art, there is known a transducer face-velocity control system for an array of underwater acoustic transducers as disclosed in U.S. Pat. No. 3,311,872 to Andrews, Jr., et al. According to that invention, the face velocity of each individual transducer is sensed either directly or indirectly (i.e., by sensing the displacement or acceleration of the face) by a second or auxiliary transducer mechanically coupled thereto. The face velocity is converted into an electrical signal and fed back as a negative feedback signal to the electrical input terminals of the individual amplifier driving the transducer whose face velocity is to be sensed. By making the product of the amplifier gain and the ratio of the feedback to input signals substantially greater than one, the face velocity of the radiating transducer is substantially independent of radiation impedance and is proportional to the driving signal, the proportionality being controlled by the feedback factor. The sensor used by Andrews, Jr., et al. is essentially a loudspeaker coil. One problem of the Andrews, Jr., et al. system is that it suffers from cross-talk.

U.S. Pat. No. 4,412,317 to Asjes et al. discloses a transducer for picking up mechanical vibrations in seismic waves. The transducer comprises two separate coils disposed in permanent magnetic fields produced by a magnet assembly. The coils and the magnetic assembly are mounted for relative movement to each other. The magnet assembly is structured and disposed relative to the two coils so as to reduce the electromagnetic coupling between the two coils to zero. One of the coils is connected to an amplifier input while the other one of the coils is included in a feedback circuit of the amplifier. When mechanical vibrations are applied to the transducer, the velocity difference between the inertial mass of the transducer and the housing thereof is reduced to zero by the current in the coil which is in the feedback circuit.

U.S. Pat. No. 3,559,050 to Mifsud discloses a velocity sensitive geophone which comprises two windings on the same coil form. The output signal produced by one winding is coupled to the other through an electrical circuit which amplifies the signal and adjusts the phase thereof. When the signal applied to the second winding is in phase with the output signal of the first winding, the device behaves as an accelerometer, but when the signals are 90 degrees out of phase, it behaves as a very low-frequency-sensitive geophone.

U.S. Pat. No. 3,208,545 to Doty et al. discloses a circuit for minimizing the phase variations occuring between a reference signal used to control a seismic vibrator and the eleastic signal transmitted by the vibrator when it is coupled to a different propagating media. In U.S. Pat. No. 4,056,163 to Wood et al., an accelerometer located on the pad of a vibratory seismic source provides a signal for comparison with the sweep signal which controls the vibrator. U.S. Pat. No. 4,286,332 to Edelmann discloses compressional wave vibrators symetrically disposed on opposite sides of a profile line of geophones. The Edelmann system includes a feedback circuit for the cancellation of compression waves. U.S. Pat. Nos. 3,718,900 to Holmes, Jr., 3,354,983 to Johnson III, and No. 3,354,983 to Erickson et al., show examples of prior art transducer structures.

What is needed is a sensor that can operate in such a manner that it is sensing the mechanical motion of a transducer element and is unaffected by either an electric or a magnetic field.

SUMMARY OF THE INVENTION

It is therefore a general object of this invention to provide a transducer velocity sensing technique which improves transducer array transmitting beam patterns.

It is a further object of the invention to provide an improved feedback device for a transducer array which substantially eliminates cross-talk at the operating frequency of the array.

It is a more specific object of the present invention to provide a sensor that can operate in such a manner that it is capable of sensing the mechanical motion of a transducer element in an array without being affected by an electric or magnetic field.

According to the invention, a differential transformer is used to sense the actual velocity of the system in the sinusoidally vibrating transducer element of a transducer array. The use of a differential transformer makes velocity control possible. The error signal sensed in this manner is originally a displacement signal; it is automatically converted to a velocity sensed signal in the signal processor. This velocity parameter is coupled by the signal processor through a feedback loop to correct for the adverse phase and amplitude effects of acoustic cross-coupling. Thus, both phase and amplitude are sensed and corrected by the signal processor before exciting the transducer element through the element power amplifier.

BRIEF DESCRIPTION OF THE DRAWINGS

The foregoing and other objects, aspects and advantages of the invention will be better understood from the following detailed description of the preferred embodiment of the invention with reference to the drawings, in which.

DETAILED DESCRIPTION OF THE PREFERRED EMBODIMENT OF THE INVENTION

Figure 1:
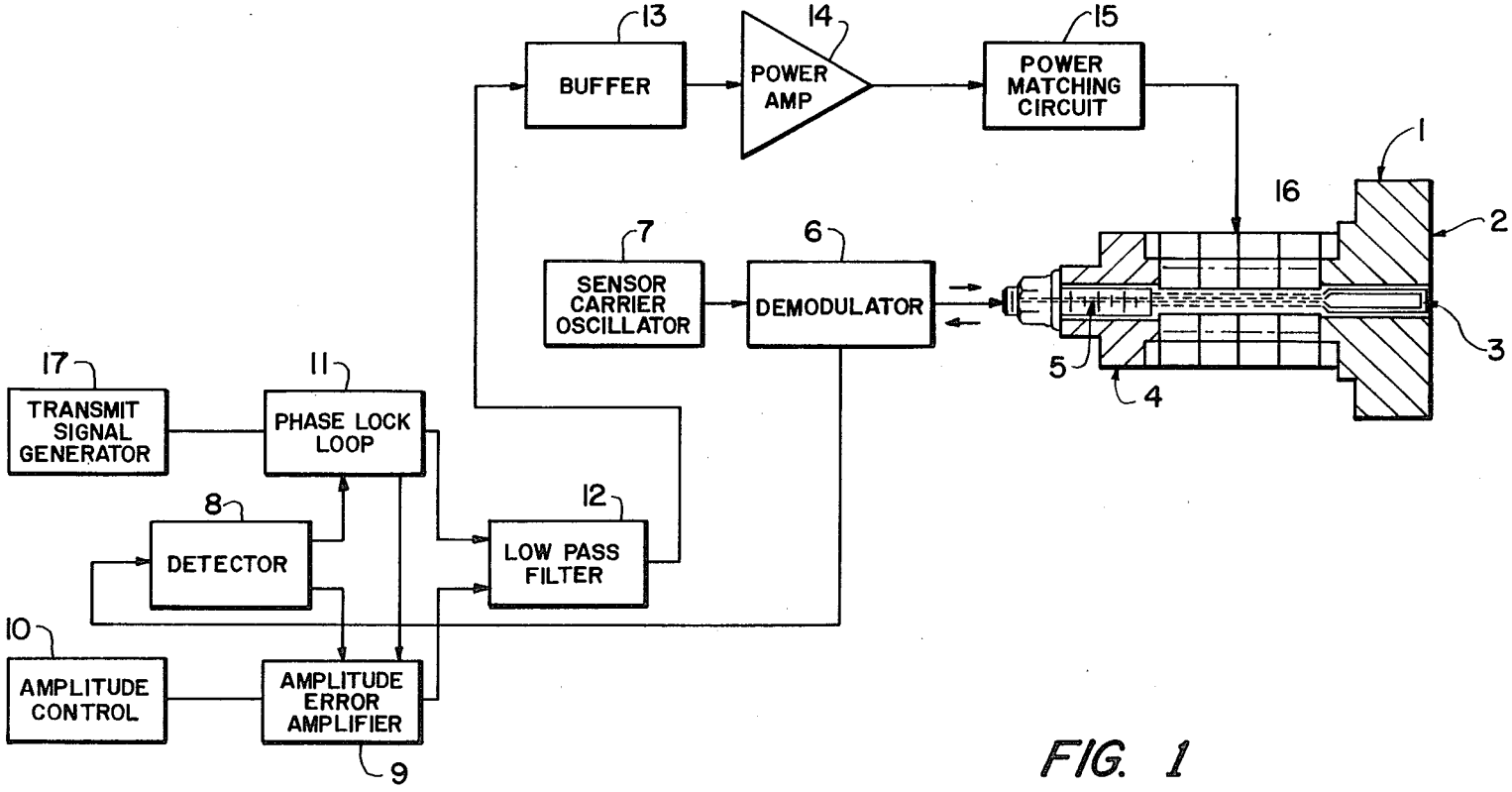
FIG. 1 is a block diagram showing the principal components of a controlled transmitting element in a sonar array that has an element velocity control capability according to the invention.

Referring now to the drawings in which like reference numerals indicate the same or equivalent components, and more particularly to FIG. 1, the transducer element 1 is typical of a sonar transmitting element that has a radiating surface 2, a tail mass 4, which by its mass locates the acoustic null, and an active driving element 16. The differential sensor 3 is located at the radiating surface area. Electrical connections to the differential sensor are made through pathway 5.

Figure 2:
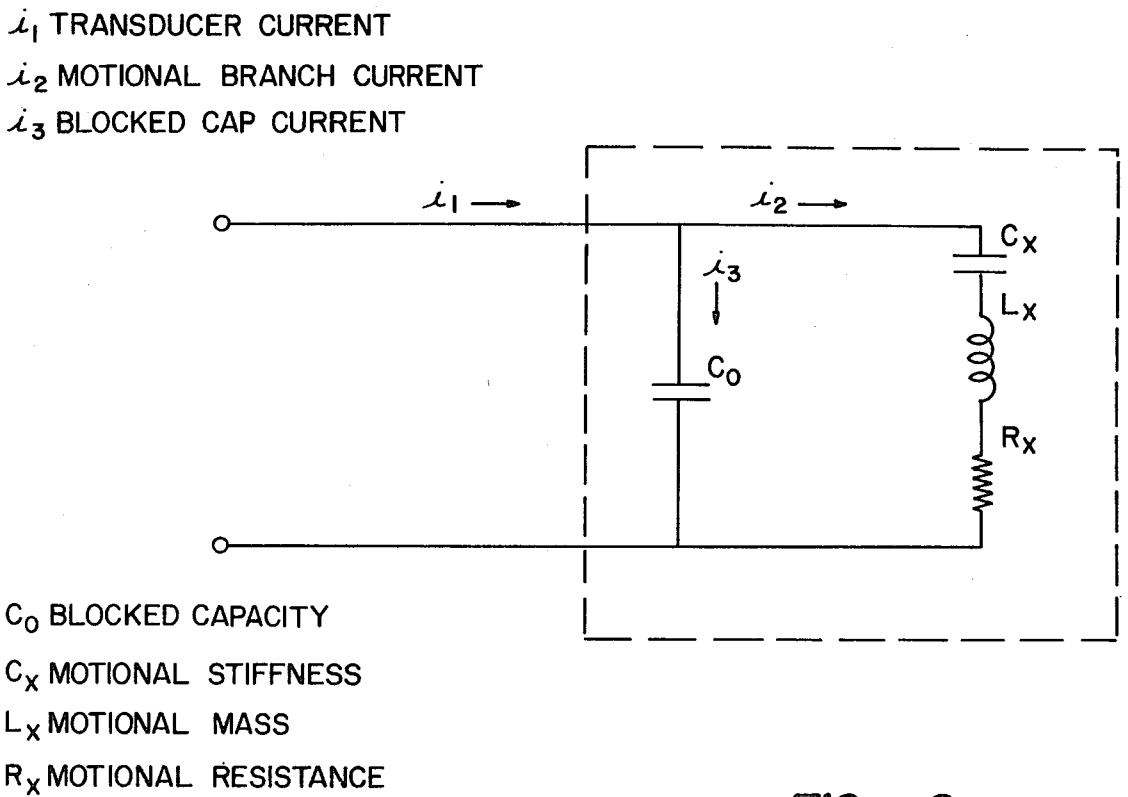
FIG. 2 is a schematic diagram of a typical sonar transducer equivalent circuit.

The transducer equivalent circuit is shown in FIG. 2. This circuit comprises two parallel branches, which may be referred to as the blocked branch and the motional branch. The blocked branch comprises a blocked capacitance $C_o$, while the motional branch comprises the series connected motional stiffness capacitance $C_x$, the motional mass inductance $L_x$, and the motional resistance $R_x$. Those skilled in the art will recognize that these circuit elements represent the dynamic analogs of the mechanical transducer. The transducer current $i_1$ splits between these two branches into currents $i_2$, the motional branch current, and $i_3$, the blocked capacity current.

It is important to note that a successful velocity control sensor must in all cases sense the motion of the transducer radiating surface. In the transducer equivalent circuit shown in FIG. 2, this motion can be identified as the direct equivalent of the electrical current $i_2$ in the motional impedance branch. It is this current that is controlled by the invention as will become apparent in the description which follows.

Figure 3:
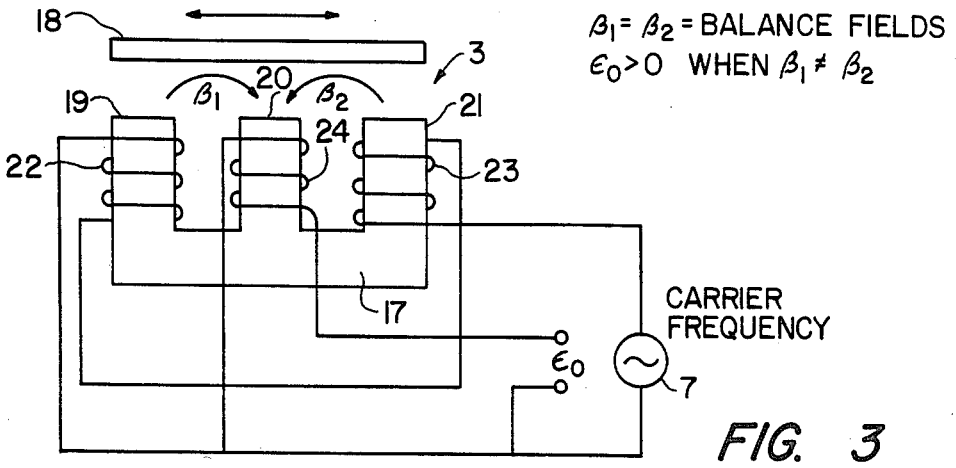
FIG. 3 is a schematic diagram of a typical differential transformer sensor.

FIG. 3 shows a typical differential transformer sensor 3 which comprises a core 17 that is magnetically coupled to a moving mass 18. The core 17 has three legs 19, 20 and 21. Excitation windings 22 and 23 are wound in opposing phase on legs 19 and 21, respectively, and connected in series with a source of sinusoidal carrier frequency signal 7. An error sensing winding 24 is wound on leg 20 and provides an output indicative of the signal coupled to that winding by the motion of the moving mass 18.

Returning now to FIG. 1, the differential sensor 3 is activated by a sensor carrier oscillator 7 through a demodulator 6. The demodulator 6 serves to couple the carrier oscillator signal to the differential sensor 3 and to demodulate the sensed displacement signal which represents the motion of the radiating surface 2. The output of a differential transformer such as the differential sensor 3 has the characteristics of a double sideband suppressed carrier signal. In this application, one sideband or the other is selected by means of a high pass or low pass filter to be processed. Although the identical phase and amplitude information is present in either sideband, only one sideband need be used.

The demodulated signal from the demodulator 6 is coupled to an amplitude and phase detector 8. The modulation, once detected, provides the phase and amplitude performance of the transducer. This phase and amplitude information, when compared with the commanded transmit signal, constitutes the transducer error signal. The detector 8 couples the signal to the phase lock loop (PLL) circuit 11 where it is compared with a signal from the transmit signal generator 17. The phase lock loop serves the purpose of correcting any phase error in the detected signal. This circuit continually monitors the signal from the transmit signal generator 17 and makes a comparison with the transmitted signal. Any phase error is compensated prior to its coupling to the amplitude error amplifier 9.

An amplitude error amplifier 9 receives a control signal from amplitude control 10 which is compared with the output from detector 8. The amplitude error amplifier senses any amplitude error by comparing the detected signal with an amplitude control signal and pulse width modulates the signal output of the phase corrected signal from the phase lock loop 11. The output of the amplitude error amplifier 9 is combined with the phase error output from PLL 11 in a low pass filter 12 to produce a corrected amplitude and phase signal. The character of the signal at the input of the low pass filter 12 is a bipolar digital signal that is pulse width modulated. The low pass filter 12 is now used to pass only the sinusoidal fundamental of this signal. The output of the low pass filter 12 is fed through a buffer 13 to a power amplifier 14, which is power matched to the transducer element 16 by means of a power matching circuit 15. The transducer element now transmits a correct amplitude and phase signal.

Figure 4A:
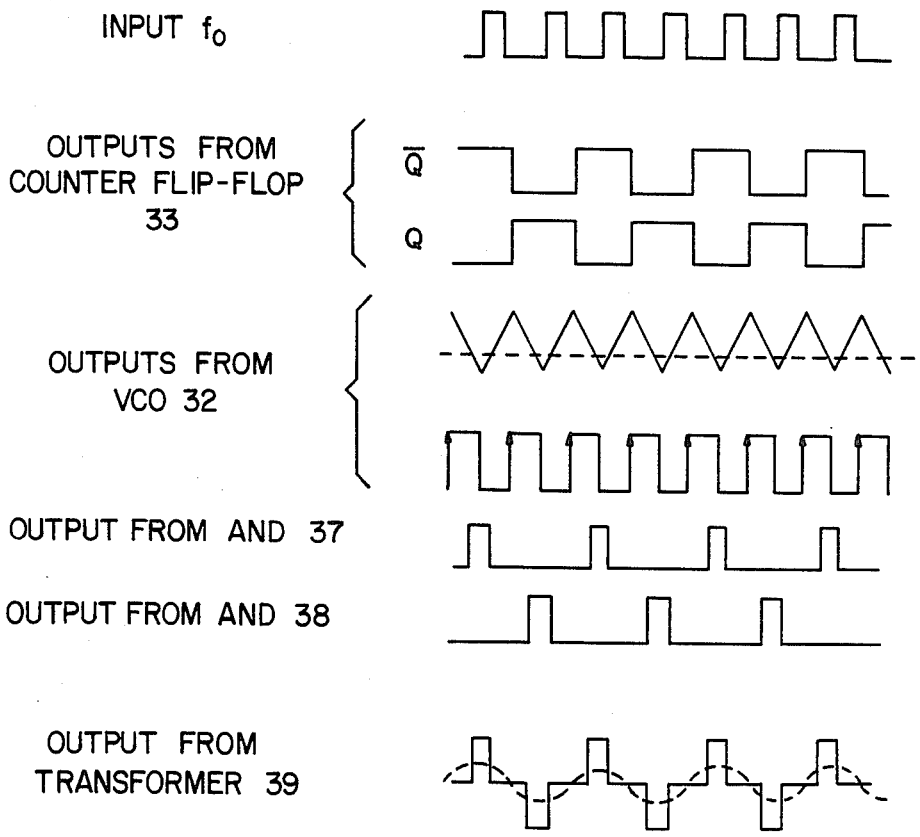
FIG. 4A is a timing diagram showing signal waveforms useful in understanding the operation of the amplitude and phase control of FIG. 4.
Figure 4:
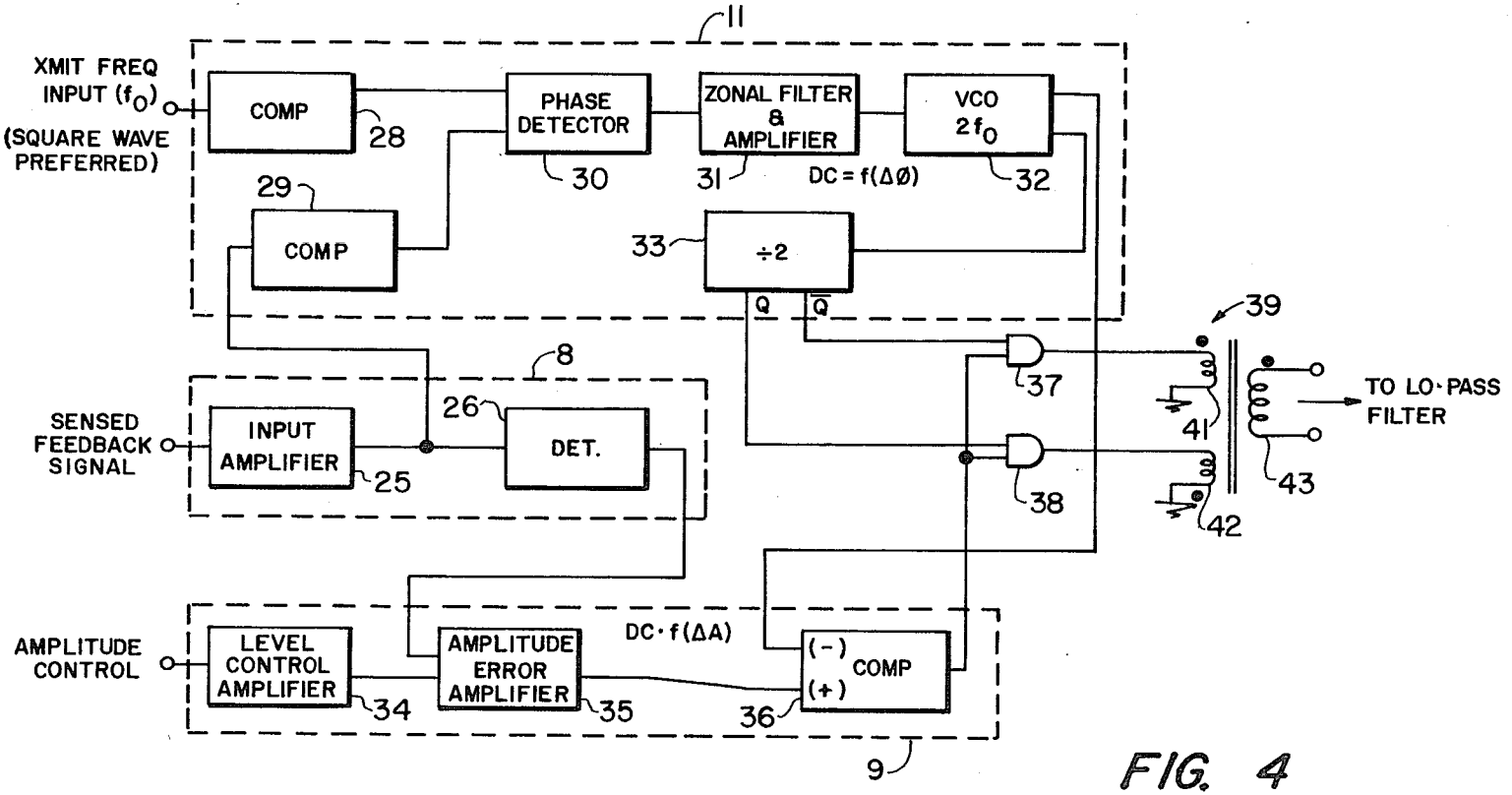
FIG. 4 is a block and logic diagram of the amplitude and phase control portion of the system shown in FIG. 1.

FIG. 4 is a block and logic diagram which shows in more detail the amplitude and phase control of the array element system block diagram of FIG. 1. In FIG. 4, the sensed feedback signal from demodulator 6 is applied to detector 8 which comprises an input amplifier 25 and an amplitude detector 26. The output of the input amplifier 25 is connected to the input of detector 26 which provides an amplitude rectified output to the amplitude error amplifier 9. The output of the input amplifier 25 is also connected to an input of the phase lock loop 11. Thus, the output from detector 26 provides amplitude feedback, while the output from input amplifier 25 provides phase feedback.

The phase lock loop 11 has two inputs, one from the transmit signal generator 17 (shown in FIG. 1) and one from the input amplifier 25 in detector 8. Preferrably, the transmit signal input from transmit signal generator 17 is a square wave and it has a frequency denoted in the drawing as $f_o$. That signal and the signal from input amplifier 25 are supplied to complementing buffer amplifier circuits 28 and 29, respectively. The outputs of these complementing buffer amplifier circuits 28 and 29 are coupled to the inputs of a phase detector 30 which provides an output corresponding to the error in the relative phase of the transmit frequency input signal and the feedback signal. The output error signal from the phase detector 30 is supplied to a zonal filter and amplifier 31. The zonal filter and amplifier 31 provides a low pass frequency filtering and rectifying function so that the output of the zonal filter and amplifier 31 is a direct current signal proportional to the phase error detected by the phase detector 30. This direct current signal is the control signal for a voltage controlled oscillator (VCO) 32 having a nominal frequency of $2f_o$. The VCO 32 has two outputs, one of which is a square wave that is supplied as the input to a divide by two counter flip-flop 33. The square wave output of the VCO 32 is shown in the timing diagram of FIG. 4A, and below that in the same figure are the two outputs $\overline{Q}$ and Q of the divide by two counter flip-flop 33.

As previously mentioned, the output of detector 25 is supplied as one input to the amplitude error amplifier 9.

That amplifier comprises a level control amplifier 34 which receives the output of amplitude control 10 (shown in FIG. 1) and provides an output to the amplitude error amplifier 35. Amplitude error amplifier 35 also receives as an input the output of detector 26 and generates a direct current signal proportional to the difference in the amplitudes of the two input signals. This direct current signal is supplied to one input of comparator 36, the other input of which is supplied by the second output of VCO 32. This second output from VCO 32, as shown in FIG. 4A, is a triangular wave signal. As will be understood by those skilled in the art, the triangular wave signal is readily produced from the square wave signal provided at the first output of the VCO 32 by simply integrating the square wave signal. The triangular wave signal is the reference signal to comparator 36, and the output of comparator 32 is a pulse width modulated signal generally as shown in FIG. 4A.

The pulse width modulated signal from the output of comparator 36 is used as a gating signal for a pair of AND gates 37 and 38, which are respectively coupled to the $\overline{Q}$ and Q outputs of the divide by two counter flip-flop 33. The outputs of the AND gates 37 and 38 are shown in FIG. 4A and comprise the two inputs to the low pass filter 12 shown in FIG. 1. The front end of the filter 12 is shown in FIG. 4 as comprising a transformer 39 having two primary windings 41 and 42 and a single secondary winding 43 wound on a common core 44. The polarities of the windings are as shown in FIG. 4 with the primary windings 41 and 42 being oppositely wound. The result is to produce a bipolar pulse width modulated output on secondary winding 43 as shown in FIG. 4A. This signal, when subjected to low pass filtering, produces a fundamental sinusoidal signal at frequency $f_o$ which is phase and amplitude corrected.

To be effective, the transmitting array requires an amplitude and phase correcting system, as shown in FIG. 1, for each element in the array. Thus, it will be understood that although a single correction circuit for but one transducer element is shown in FIG. 1, in practice a plurality of such correction circuits are required, one for each element in the array.

While the invention has been described in terms of a single preferred embodiment, those skilled in the art will recognize that the invention can be practiced with modification within the spirit and scope of the claims.

Having thus described my invention, what I claim as new and desire to secure by Letters Patent is as follows:

1. A transducer array velocity sensor and processor system for improving transmitting beam patterns in a sonar transducer array, comprising for each transducer in the array:

a differential transformer having a moving mass connected to mo.ev with a radiating surface of the transducer, a pair of oppositely wound excitation windings and a sensing winding;

a sensor carrier oscillator connected to said pair of excitation windings;

detector means connected to said sensing winding for providing first and second outputs proportional to the phase and amplitude of the motion of said radiating surface;

phase locked loop means connected to receive the first output from said detector proportional to the phase of the motion of said radiating surface for comparing said output with a transducer transmit signal to produce a phase error signal;

amplitude error means connected to receive the second output from said detector proportional to the amplitude of the motion of said radiating surface for comparing said output with an amplitude control signal to produce an amplitude error signal; and means for combining said phase and amplitude error signals for generating a corrected drive signal for said transducer.

2. The transducer velocity sensor and processor system as recited in claim 1 wherein said means for combining comprises:

low pass filter means connected to receive the outputs of said phase locked loop means and said amplitude error means for providing a corrected amplitude and phase signal output; and power amplifier means connected to receive said corrected amplitude and phase signal output for providing an amplified drive signal to said transducer.

3. The transducer velocity sensor and processor system as recited in claim 2 wherein said differential transformer further comprises a core having three legs, one said legs being between the other two legs and magnetically coupled thereto by said moving mass, said excitation windings being wound on respective ones of said other two legs and said sening winding being wound on said one leg.

4. The transducer velocity sensor and processor system as recited in claim 2 wherein said means for combining further comprises pulse width modulating means responsive to said phase and amplitude error signals for producing a bipolar pulse width modulated signal which is supplied to said low pass filter.

5. The transducer velocity sensor and processor system as recited in claim 2 wherein said phase locked loop means comprises:

voltage controlled oscillator means having a nominal frequency of twice said transmit signal, said voltage controlled oscillator means having two outputs, one output being a square wave output and one output being a triangular wave output; and divide by two means responsive to said square wave output for producing first and second oppositely phased square wave outputs having a frequency of said transmit signal;

and wherein said means for combining comprises:

comparing means having two inputs, one input being connected to receive the amplitude error signal and one input being connected to receive said triangular wave output from said voltage controlled oscillator means, said comparing means producing a pulse width modulated output;

first and second gating means connected to receive said pulse width modulated output from said comparing means, said first gating means being enabled by the first output of said divide by two means and said second gating means being enabled by the second output of said divide by two means; and means for combining the outputs of said first and second gating means for producing a bipolar pulse width modulated signal for supplying to said low pass filter means.

* * * * *